US007063054B2

(12) United States Patent
Minato et al.

(10) Patent No.: US 7,063,054 B2
(45) Date of Patent: Jun. 20, 2006

(54) VALVE DRIVING DEVICE OF AN INTERNAL COMBUSTION ENGINE

(75) Inventors: Akihiko Minato, Fujisawa (JP); Shigehisa Takase, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 113 days.

(21) Appl. No.: 10/473,256

(22) PCT Filed: Mar. 29, 2002

(86) PCT No.: PCT/JP02/03190

§ 371 (c)(1),
(2), (4) Date: Sep. 26, 2003

(87) PCT Pub. No.: WO02/079614

PCT Pub. Date: Oct. 10, 2002

(65) Prior Publication Data

US 2004/0107924 A1 Jun. 10, 2004

(30) Foreign Application Priority Data

Mar. 29, 2001 (JP) ..... 2001-96029

(51) Int. Cl.
*F01L 9/02* (2006.01)

(52) U.S. Cl. ..... 123/90.12; 123/90.15; 137/1; 251/30.01

(58) Field of Classification Search ..... 123/90.12, 123/90.13, 90.15; 137/1; 251/30.01, 63.6
See application file for complete search history.

(56) References Cited

U.S. PATENT DOCUMENTS 4,443,853 A * 4/1984 Maciolek et al. ..... 701/3

(Continued)

FOREIGN PATENT DOCUMENTS

EP 999 350 A1 5/2000

(Continued)

OTHER PUBLICATIONS

Copy of International Search Report from PCT/JP02/03190 dated Jun. 25, 2002.

*Primary Examiner*—Thomas Denion
*Assistant Examiner*—Zelalem Eshete
(74) *Attorney, Agent, or Firm*—McCormick, Paulding & Huber LLP

(57) ABSTRACT

The object of the present invention is to provide a camless valve driving device, without having a cam mechanism, which can reduce the valve driving energy and enhances fuel efficiency. According to the one preferred aspect of the present invention, the valve driving device of an internal combustion engine includes a pressure chamber, to which actuating fluid, to drive opening and closing of a main valve serving as an intake valve or as an exhaust valve of the internal combustion engine, is supplied; a first actuating valve for supplying high-pressure (Pc) actuating fluid to the pressure chamber during a prescribed period (tCP1) of the initial valve opening period of the main valve; a second actuating valve for introducing low-pressure (Pf) actuating fluid to the pressure chamber after the prescribed period (tCP1) has elapsed; a third actuating valve for discharging actuating fluid from the pressure chamber when the main valve is closed. According to the another preferred aspect, the valve driving device of an internal combustion engine further includes a valve spring and a magnet to impel the main valve toward the closed direction. Accordingly, the holding force of the main valve during the main valve opening period is restrained to the minimum, and the valve driving energy is decreased.

10 Claims, 6 Drawing Sheets

U.S. PATENT DOCUMENTS 5,117,213 A * 5/1992 Kreuter et al. ..... 335/219
5,255,641 A 10/1993 Schechter ..... 123/90.11
5,275,136 A 1/1994 Schechter et al. ..... 123/90.12
5,839,453 A * 11/1998 Hu ..... 123/322
6,067,946 A * 5/2000 Bunker et al. ..... 123/90.12
6,170,445 B1 1/2001 Hattori et al. ..... 123/90.11

FOREIGN PATENT DOCUMENTS

JP 04-027704 1/1992
WO 97/06354 2/1997

* cited by examiner

FIRST ACTUATING VALVE COMMAND PULSE

BALANCE VALVE OPENING

PRESSURE IN PRESSURE CHAMBER

SECOND ACTUATING VALVE OPENING

THIRD ACTUATING VALVE OPENING

MAIN VALVE LIFT

VALVE DRIVING DEVICE OF AN INTERNAL COMBUSTION ENGINE

TECHNICAL FIELD

This application is entitled to the benefit of and incorporates by reference essential subject matter disclosed in Japanese Patent Application No. 2001-96029 filed on Mar. 29, 2001 and PCT application No. PCT/JP02/03190 filed Mar. 29, 2002.

The present invention relates to a valve driving device of an internal combustion engine, and in particular to a device which performs opening and closing of a valve system using fluid pressure, without having a cam mechanism.

BACKGROUND ART

So-called camless valve driving devices, which eliminate cams for valve driving and instead employ electromagnetic driving or hydraulic driving of the valve in order to enhance freedom of engine control, are viewed as promising. Such technology is disclosed in Japanese Patent Publication No. 7-62442 and in Japanese Patent No. 3019275 and the valve opening and closing timing and lift amount of the device can be set freely.

In such a device, high fluid pressure is developed that is sufficient to lift the valve by the necessary amount in opposition to the valve spring, and this pressure is applied to the valve to perform the desired lifting. However, when a large amount of energy is required to apply high fluid pressure to the valve for valve driving the valve driving loss is increased, and there is the disadvantage that reduced fuel efficiency may result.

DISCLOSURE OF THE INVENTION

An object of the present invention is to provide a valve driving device of an internal combustion engine which can reduce the valve driving loss and improves fuel efficiency.

Another object of the present invention is to provide a valve driving device of an internal combustion engine which can reduce the open-valve holding force when holding the open-valve condition and the valve driving energy.

Still another object of the present invention is to provide a valve driving device of an internal combustion engine which utilizes fluid pressure to open a valve by way of the valve driving energy which is equivalent to that of an ordinary cam driving system.

In order to accomplish above objects, the driving device to drive the opening and closing of a main valve serving as an intake valve or as an exhaust valve of an internal combustion engine, comprises a pressure chamber to which is supplied pressurized actuating fluid to open the main valve; a high-pressure actuating fluid supply means, which supplies the high-pressure actuating fluid to the above pressure chamber during the prescribed interval in the initial opening period of the above main valve; a low-pressure actuating fluid introduction means which introduces the low-pressure actuating fluid into the pressure chamber after the prescribed interval in the initial opening period of the main valve has elapsed; and an actuating fluid discharge means which discharges the above-mentioned actuating fluid from the pressure chamber to close the main valve.

It is preferable that the high-pressure actuating fluid supply means supplies the high-pressure actuating fluid even in the midst of the prescribed interval of the open-valve condition.

It is also preferable that the high-pressure actuating fluid supply means includes a first actuating valve to switch between supplying and halting the supply of high-pressure fluid to the pressure chamber; the low-pressure actuating fluid introduction means includes a second actuating valve to switch between introducing and halting the introduction of the low-pressure actuating fluid to the pressure chamber; and the actuating fluid discharge means includes a third actuating valve to switch between discharging and halting the discharge of the above actuating fluid from the pressure chamber.

It is also preferable that the low-pressure actuating fluid introduction means includes a low-pressure chamber which stores the low-pressure actuating fluid and a supply passage which is connected to the above pressure chamber and directly introduces the low-pressure actuating fluid stored in the low-pressure chamber to the pressure chamber, and the second actuating valve comprises a check-valve provided at the exit part of the low-pressure route.

It is also preferable that the first actuating valve includes a needle-shaped balance valve; a supply passage, facing to the one end of the balance valve, which is opened and closed by the balance valve for circulating high-pressure actuating fluid which is supplied to the pressure chamber; a valve control chamber in which the high-pressure actuating fluid for driving the balance valve in a closed direction facing to one end of the balance valve; a spring for impelling the balance valve toward a closed direction; an armature which opens and closes the exit of the valve control chamber; and an electrical actuator for driving the opening and closing of the armature in response to the ON/OFF signal.

It is preferable that the electrical actuator comprises an electromagnetic solenoid.

It is preferable that the third actuating valve opens when the main valve starts to close, and closes before the main valve is fully closed.

It is preferable that at least either a valve spring or a magnet is provided to impel the main valve toward the closed position.

It is preferable that both the valve spring and the magnet are provided.

It is preferable that the magnet comprises a permanent magnet.

It is preferable that a piston, connected to the main valve, having a pressure-receiving face which is partitioning one side of the pressure chamber, is provided; and during the period when the main valve changes from fully closed to fully open, the ratio of the amount of increase in volume of the pressure chamber to the amount of the piston movement is held constant.

It is preferable that the internal combustion mechanism comprises a common-rail diesel engine; the actuating fluid is engine fuel; the high-pressure actuating fluid is fuel pressured and stored into the common-rail; and the low-pressure actuating fluid is fuel at feed pressure.

According to the one aspect of the present invention, when the main valve is opened (lifted), the high-pressure actuating fluid is supplied into the pressure chamber during a prescribed period of the initial opening of the main valve. Accordingly, the high-pressure actuating fluid is vigorously sprayed into the pressure chamber, and the initial energy is applied to the main valve by way of the pressure increase in the pressure chamber. Thereafter, the main valve moves inertially and is lifted. In this process, when the pressure in the pressure chamber falls below the pressure in the low-pressure chamber, the low-pressure fuel is automatically introduced to the pressure chamber. By this means a larger amount of actuating fluid is supplied to the pressure chamber, exceeding the amount of high-pressure fuel actually supplied, so that negative pressure in the pressure chamber is avoided and main valve lifting action is stabilized, while at the same time the amount of main valve lifting can be held to a lift amount corresponding to the initial energy applied through the supply of high-pressure fuel. As a result, the driving energy required during the main valve lifting can be reduced.

According to another aspect of the present invention, a valve spring and a magnet are provided to impel the main valve towards the closed direction. The valve spring increases the force in the closed-valve direction (upward) and the load still more as the main valve is lifted. In contrast, the magnet decreases the force in the closed-valve direction (upward) and the load still more as the main valve is lifted. By utilizing both effects, a minimum amount of the load force is held and the excess increment of the force load in the closed-valve direction caused by the main valve lifting can be avoided and also the valve driving energy can be decreased.

Other objects, features, and effects of the present invention will become apparent to those skilled in the art upon a further reading and comprehending of the detailed description of the present invention presented herein below.

BEST MODE FOR CARRYING OUT THE INVENTION

Below, preferred aspects of the invention are explained, based on the attached drawings.

Figure 1:
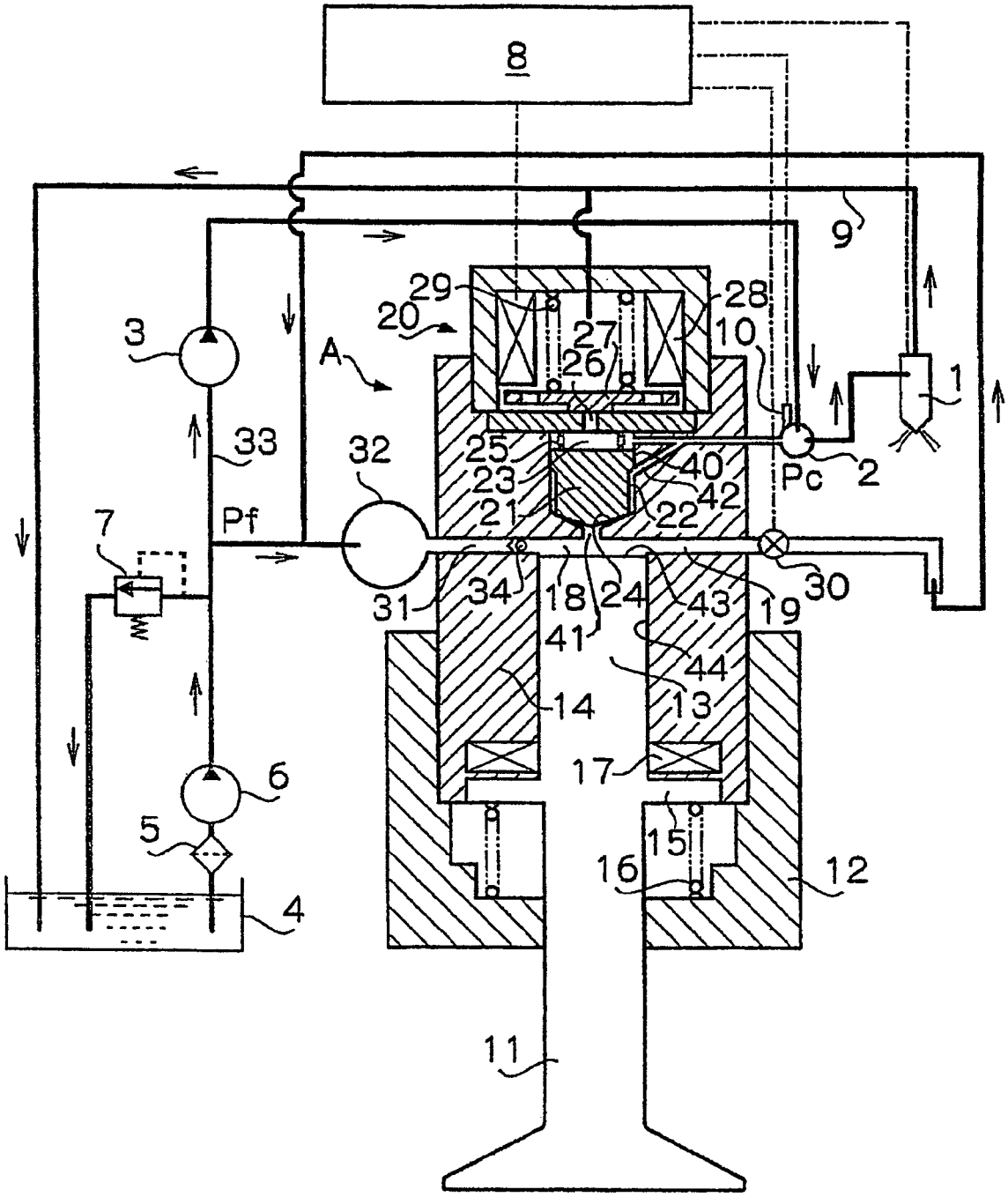
FIG. 1 is an overall view of a valve-driving device of an aspect of the present invention.

FIG. 1 shows an overall view of a valve driving device of an aspect of this invention. This aspect is an example of application to a common-rail diesel engine for vehicular and other uses. First a common-rail fuel-injection device is explained. An injector 1 which executes fuel injector into each cylinder of the engine is provided, and high-pressure fuel at a common-rail pressure Pc (from several tens to several hundreds of MPa), stored in a common rail 2, is constantly supplied to the injector 1. Pressurized transport of fuel to the common rail 2 is performed by the high-pressure pump 3, and after fuel from the fuel tank 4 is suctioned out by the feed pump 6 via the fuel filter 5, it is sent to the high-pressure pump 3. The feed pressure Pf of the feed pump 6 is adjusted using a relief valve consisting of a pressure adjustment valve 7, and is held constant. The feed pressure Pf is lower than the common rail pressure Pc, at for example a value of 0.5 MPa.

An electronic control unit (hereafter "ECU") 8 is provided as a control device for comprehensive control of the entire apparatus shown, and is connected to sensors (not shown) which detect the engine operating state (engine crank angle, rotation speed, engine load, and similar). The ECU 8 determines the engine operating state based on signals from these sensors, and based on this sends driving signals to the electromagnetic solenoid of the injector 1. Fuel injection is executed or halted according to whether the electromagnetic solenoid is on or off. When injection is halted, fuel at approximately normal pressure is returned from the injector 1 to the fuel tank 4 via the return path 9. The ECU 8 performs feedback control to move the actual common rail pressure toward a target pressure, based on the engine operating state. To this end, a common rail pressure sensor 10 for detecting the actual common rail pressure is provided.

Next, a valve driving device of this invention is explained. 11 is the main valve serving as an intake or exhaust valve for the engine. The main valve 11 is supported, in a manner enabling free rising and falling, by the cylinder head 12, and the upper end of the main valve 11 is integrated with the piston 13. That is, the piston 13 is linked integrally to the main valve 11. A main valve driving actuator A serving as the principal component of this device is provided on the upper portion of the main valve 11, and the actuator body 14 thereof is fixed on the cylinder head 12. The piston 13 is capable of vertical sliding within the actuator body 14. The example shown is of a single main valve for a single cylinder, but when opening and closing control is to be performed, for numerous cylinders or for numerous main valves, these valves may be provided with the same configuration. In this aspect, the main valve 11 and piston 13 are formed integrally, but may be configured as separate members.

A flange portion 15 is provided in the main valve 11, and a valve spring 16 which impels the main valve 11 toward the closed position (upward in the figure) is arranged, in a compressed state, between the flange portion 15 and cylinder head 12. Here, the valve spring 16 comprises a coil spring. A magnet 17 which draws the flange portion 15 is embedded within the actuator body 14, and by this means also the main valve 11 is impelled toward the closed position. Here, the magnet 17 is a permanent magnet in a ring shape so as to surround the main valve 11. The piston 13 comprises at least the portion at the upper end of the main valve 11, and is inserted into the actuator body 14 while forming a shaft seal.

A pressure chamber 18 facing the upper-end face (that is, the pressure-receiving face 43) of the piston 13 is formed by partitioning within the actuator body 14. The pressure chamber 18 is supplied with pressurized actuating fluid in order to open the main valve 11, and is formed by partitioning with the pressure-receiving face 43 as the bottom face portion. As the actuating fluid, a light oil which is also employed as the engine fuel, is used. When high-pressure fuel is supplied to the pressure chamber 18, the main valve 11 is pressed in the open position (downward in the drawing), and when this pressing force exceeds the impelling force of the valve spring 16 and the magnet 17, the main valve 11 is opened downward (lifted). On the other hand, when a discharge passage is connected to the pressure chamber 18 and high-pressure fuel is discharged from the pressure chamber 18, the main valve 11 is closed.

A first actuating valve 20 is provided above the pressure chamber 18 to switch between supplying and halting the supply of high-pressure fuel to the pressure chamber 18. In this aspect, the first actuating valve 20 comprises a pressure-balanced control valve.

The first actuating valve 20 has a needle-shaped balance valve 21 positioned coaxially with the main valve 11. A shaft sealing portion 40 is formed on the upper end of the balance valve 21, and a supply passage 22 and valve control chamber 23 are formed by partitioning below the shaft sealing portion 40 and above the shaft sealing portion 40, respectively. The upper-end face of the balance valve 21 is a face to receive the pressure of fuel within the valve control chamber 23. The supply passage 22 and valve control chamber 23 are connected to the common rail 2 as a high-pressure actuating fluid supply source, via a branch passage 42 formed within the actuator body 14 and an external pipe, and are constantly supplied with high-pressure fuel at the common rail pressure Pc. As is seen below, lifting of the main valve 11 occurs due to the high-pressure fuel at this common rail pressure Pc.

The supply passage 22 is linked to the pressure chamber 18 facing the lower side of the balance valve 21, and the midway point has a valve seat 24 which makes linear or plane contact with the lower-end conical face of the balance valve 21. An outlet 41 of the supply passage 22 (that is, an inlet for high-pressure fuel to the pressure chamber 18) is provided on the downstream side of the valve seat 24. The outlet 41 positioned coaxially with the main valve 11, is directed toward the pressure-receiving face of the piston 13. The high-pressure actuating fluid discharged or sprayed from the outlet 41 is introduced to the pressure chamber 18. The outlet 41 is also directed in the direction of movement or the axial direction of the main valve 11 or the piston 13. The pressure-receiving face 43 is a round-shaped surface perpendicular to the axial direction.

A spring 25 which impels the balance valve 21 in the closed direction (the lower side in the drawing) is provided in the valve control chamber 23. The spring 25 comprises a coil spring, inserted into the position in a compressed state in the valve control chamber 23. The valve control chamber 23 is linked to the return path 9 via the orifice 26, which is a fuel outlet. An armature 27 is provided, in a manner enabling vertical motion, above the orifice 26 as an on-off valve which opens and closes the orifice; above the armature 27 are provided an electromagnetic solenoid 28 as an electrical actuator and an armature spring 29, which drive the rising and falling (opening and closing) thereof. The electromagnetic solenoid 28 is connected to the ECU 8, and is turned on and off by signals, that is command pulses, applied by the ECU 8.

Normally when the electromagnetic solenoid 28 is off, the armature 27 is pressed downward by the armature spring 29, and the orifice 26 is closed. On the other hand, when the electromagnetic solenoid 28 is turned on, the armature 27 rises in opposition to the impelling force of the armature spring 29, and the orifice 26 is opened.

The low-pressure chamber 32, which is a low-pressure actuating fluid source having prescribed volume is directly connected to the pressure chamber 18, via the passage 31 within the actuator body 14. The low-pressure chamber 32 is connected to the feed path 33 which is on the downstream side of the pressure adjustment valve 7 and on the upstream side of the high-pressure pump 3, and is constantly supplied with and stores low-pressure fuel at feed pressure Pf from the feed path 33. A mechanical check valve 34 as a second actuating valve is provided at the passage 31, which opens only when the pressure in the pressure chamber 18 is lower than that of the low-pressure chamber 32.

On the other hand, a third actuating valve 30 is provided in the discharging passage 19 to switch between discharging and halting the discharge of fuel from the pressure chamber 18. The third actuating valve 30, which is a magnetic throttle valve having a variable opening degree, is connected to ECU 8 and is controlled to switch between opening and closing by the signal from ECU 8, in other words, command pulse. The outlet of the discharging passage 19 is connected to the feed path 33 which is on the downstream side of the pressure adjustment valve 7 and on the upstream side of the high-pressure pump 3, in the same manner that the low-pressure chamber 32 is connected.

The pressure chamber 18 comprises a piston insertion hole 44 of circular cross-sectional shape and fixed radius, formed mainly within the actuator body 14; the piston 13 is slidably inserted into the piston insertion hole 44. During the period when the main valve 11 changes from fully closed to fully open, the piston 13 never leaves (is never removed from) the piston insertion hole 44, and the piston 13 is always in contact with the inner face of the piston insertion hole 44. In other words, during the period when the main valve 11 changes from fully closed to fully open, the ratio of the amount of increase in volume of the pressure chamber 18 to the amount of movement of the piston 13 is held constant.

Next, the operation of this aspect is explained.

First, the operation of the first actuating valve 20 is explained. In the state of FIG. 1, the electromagnetic solenoid 28 is turned off and the orifice 26 is closed by the armature 27; in addition, the balance valve 21 is seated in the valve seat 24, in the valve-closed state. At this time, the balance valve 21 receives pressure due to the high-pressure fuel in the downward and upward directions from the upper-side valve control chamber 23 up to the shaft seal portion 40, and from the lower-side supply passage 22, respectively. However, because the balance valve 21 is seated in the valve seat 24, the surface area of the surface receiving downward pressure is markedly larger than the surface area of the surface receiving upward pressure, and moreover the balance valve 21 is also pushed downward by the spring 25, so that the balance valve 21 is pressed downward hard against the valve seat 24.

Next, when the electromagnetic solenoid 28 is turned on, the armature 27 rises and the orifice 26 opens, the valve control chamber 23 goes to low pressure due to the discharge of fuel. As a result the upward force on the balance valve 21 exceeds the downward force, and the balance valve 21 rises. Consequently the outlet 41 of the supply passage 22 is opened, and high-pressure fuel is vigorously supplied to the pressure chamber 18 via the outlet 41 of the supply passage 22.

Next, when the electromagnetic solenoid 28 is turned off, the armature 27 falls and the orifice 26 is closed, fuel discharge from the valve control chamber 23 is halted, and the pressure in the valve control chamber 23 gradually rises. In this process, before the balance valve 21 is seated in the valve seat 24, the downward pressure received by the balance valve 21 from the high-pressure fuel of valve control chamber 23 and the upward pressure received by the balance valve 21 from the high-pressure fuel of the supply passage 22 are balanced, so that the balance valve 21 falls due solely to the downward force of the spring 25. However, once the balance valve 21 is seated in valve seat 24, a state similar to the above-described valve-closed state is created, the balance valve 21 is strongly pressed against the valve seat 24, and the outlet 41 of the supply passage 22 is closed.

Figure 2:
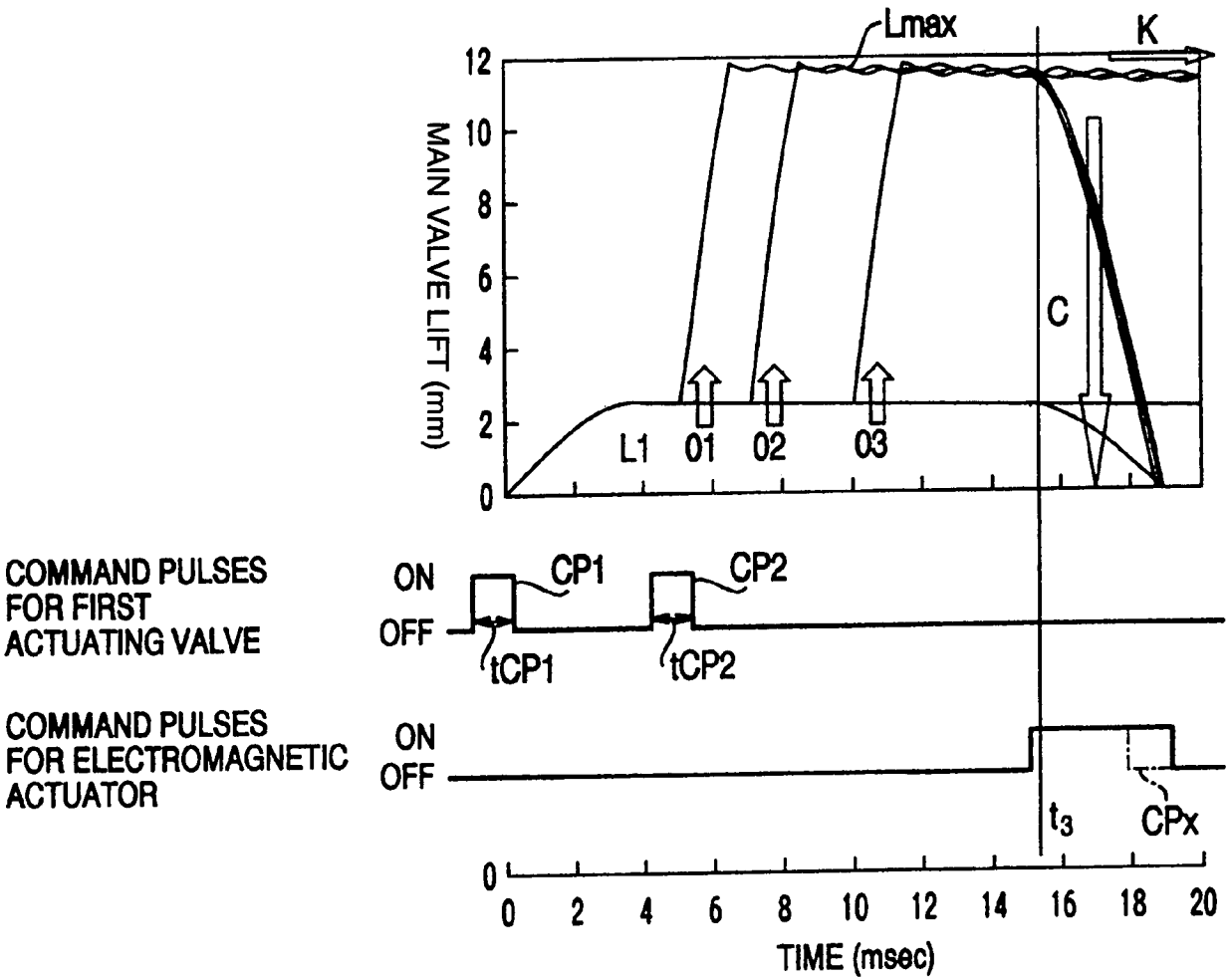
FIG. 2 is a time chart showing the details of valve control in this aspect.

Next, the operation of the valve driving device is explained in reference to the FIG. 1 and FIG. 2. The upper area of FIG. 2 shows the valve lifting (mm); the middle area of the drawing shows command pulse applied to the electromagnetic solenoid 28 of the first actuating valve 20 by the ECU 8; and the lower area of the drawing shows the command pulses applied to the third actuating valve 30 by the ECU 8.

First, when the main valve 11 is opened (lifted) from the closed state, the third actuating valve 30 is held in the off state. Also, prior to the prescribed interval, which takes actuation lag into account, to a prescribed valve opening initial period (the position of time "0"), determined based on the engine operating state, the electromagnetic solenoid 28 is turned on for a comparatively short prescribed interval tCP1. In other words, the first actuating valve 20 is opened for a prescribed interval tCP1 at the initial period of opening of the main valve 11. The armature 27 in the first actuating valve 20 rises and the orifice 26 opens, high-pressure fuel in the valve control chamber 23 is discharged, the balance valve 21 rises, and the balance valve 21 is removed from the valve seat 24. By this means the supply passage 22 is opened, and high-pressure fuel is vigorously sprayed into the pressure chamber 18 from the outlet 41 of the supply passage 22. By means of this high-pressure fuel, the pressure-receiving surface 43 of the piston 13 is pressed, so that initial energy is applied to the main valve 11, and thereafter, the main valve 11 moves inertially and is lifted downward under the conditions of action by the valve spring 16 and magnet 17. The action to open the main valve 11 lags behind the supply or collision of high-pressure fuel.

In the process of inertial motion of the main valve 11, the volume of the pressure chamber 18 increases gradually. However, because of the fact that the motion of the main valve 11 is inertial motion due to high-pressure fuel at a pressure of several tens to several hundreds of MPa, the actual amount of volume increase of the pressure is larger than the theoretical increase in volume of the pressure chamber 18 corresponding to the amount of high-pressure fuel supplied, and the pressure in the pressure chamber 18 falls below the pressure of the low-pressure chamber 32. As a result, the check valve 34 is automatically opened, and the low-pressure fuel of the low-pressure chamber 32 is directly introduced to the pressure chamber 18 via the passage 31. By this means a larger amount of fuel is supplied to the pressure chamber 18, exceeding the amount of high-pressure fuel actually supplied, so that negative pressure in the pressure chamber 18 is avoided and main valve lifting action is stabilized, while at the same time the amount of main valve lifting can be held to a lift amount corresponding to the initial energy applied through the supply of high-pressure fuel. As a result, the driving energy required during the main valve lifting can be reduced.

In this embodiment, after a first command pulse CP1, a second command pulse CP2 is applied to the electromagnetic solenoid 28 of the first actuating valve 20. That is, the first actuating valve 20 is also opened for the prescribed interval tCP2 in the midst of opening of the main valve 11, and the first actuating valve 20 is opened in two stages. By means of the inflow of high-pressure fuel and low-pressure fuel into the pressure chamber 18 resulting from the first command pulse CP1, the main valve 11 is temporarily held at an intermediate opening L1, and thereafter the main valve 11 is lifted to the maximum lifting position $L_{max}$ by the inflow high-pressure fuel and low-pressure fuel into the pressure chamber 18 resulting from the second command pulse CP2, by a method similar to that described above. Through this two stage main valve lifting, a lift curve approximating the case of ordinary cam driving (shown by the broken line) can be obtained.

Next, when the main valve is to be closed, the first actuating valve 20 is held closed (the electromagnetic solenoid 28 is turned off), and the third actuating valve 30 is turned on prior to a prescribed time, taking actuation delay into account, to a prescribed valve-closing initiation period (the position of time "t3") determined based on the engine operating state. With this, high-pressure fuel in the pressure chamber 18 passes through the discharge passage 19, and is discharged into the feed path 33. By this means, the pressure in the pressure chamber 18 falls, and the main valve 11 rises, that is, is closed, due to the impelling force of the valve spring 16 and magnet 17.

Thus, in this device, by controlling the first actuating valve 20 and the third actuating valve 30, the main valve 11 can be opened and closed with any timing, independently of the engine crank angle. As indicated by 01, 02 and 03 in FIG. 2, by shifting the output time of the second command pulse CP2, the timing with which the main valve goes from the intermediate opening L1 to fully open $L_{max}$ can also be shifted. The same is true of the valve closing timing. However, the example shown is of valve closing with fixed timing C. Through duty control of the third actuating valve 30, the amount of high-pressure fuel flowing out from the pressure chamber 18 can be controlled and the speed at which the main valve 11 is closed can also be controlled. The third actuating valve 30 can also be held in the off position to hold the main valve 11 fully open, as indicated by K.

And as indicated by the hypothetical line CPx, if the third actuating valve 30 is turned off immediately before the main valve 11 is fully closed, the pressure in the pressure chamber 18 rises gradually from the time of being turned off, due to the closing action of the main valve 11, so that shocks and seating noise when the valve is seated can be mitigated.

FIG. 8 shows the action of each portion in the device of this aspect, from main valve opening to closing. In this example, as indicated in FIG. 8*a* in the drawing, a command pulse with prescribed interval tCP1 is applied to the first actuating valve 20 only in the initial opening period of the main valve, so that the first actuating valve 20 is opened.

Figure 8A:
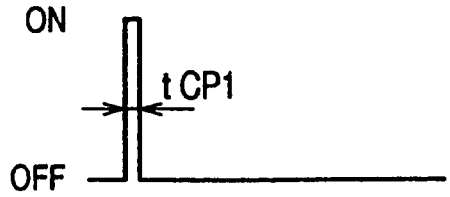
Figure 8B:
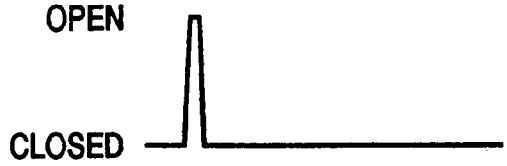
Figure 8C:
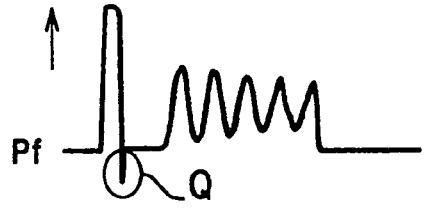
Figure 8D:
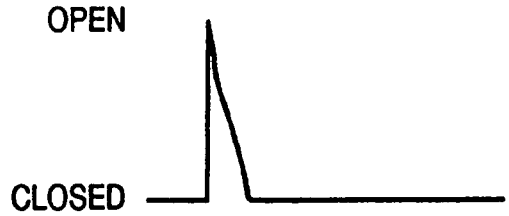
Figure 8E:
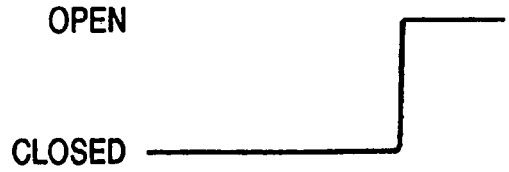
Figure 8F:
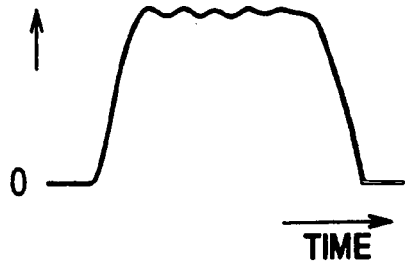

When a command pulse is applied to the first actuating valve 20 (FIG. 8*a*), the balance valve opens (FIG. 8*b*), and the pressure inside the pressure chamber 18 instantly rises due to the inflow of high-pressure fuel (FIG. 8C). By this means, opening of the main valve 11 is begun after a prescribed time from the occurrence of the command pulse (FIG. 8*f*). The first actuating valve 20 is turned off for a short period, and at the same time the balance valve is closed, so that the supply of high-pressure fuel to the pressure chamber 18 is halted; but because the main valve 11 is undergoing inertial motion, the main valve 11 does not stop immediately, consequently an increase in the volume of the pressure chamber 18 greater than that corresponding to the amount of inflow of high-pressure fuel occurs, so that the pressure in the pressure chamber 18 momentarily falls below the feed pressure Pf (Q in FIG. 8*c*). Consequently, the check valve 34 is opened, low-pressure fuel is introduced into the low-pressure chamber 32 (FIG. 8*d*), main valve lifting is executed by the initial energy due to the high-pressure fuel inflow, and the main valve 11 is fully opened. At this time minute vibrations occur in the main valve 11 accompanying energy conversions between the liquid pressure in the pressure chamber 18 and the valve spring 16, but these are not on a level regarded as problematic. Next, when the third actuating valve 30 is opened through the action of high-pressure fuel (FIG. 8*e*), so that the main valve 11 is closed.

Next, advantageous results of this aspect are explained in greater detail.

When main valve lifting is begun, the pressure of the pressure chamber 18 rises in proportion to the open-valve time of the balance valve 21. From the moment that the downward force presented by the product of this pressure and the cross-sectional area Ap of the piston 13 exceeds the sum of the set force of the valve spring 16 and the attractive force of the magnet 17, the main valve begins a downward motion.

In the piston-valve motion system, the energy related to the main valve in a stationary state after being lifted to an arbitrary position is expressed by eq. (1), ignoring friction and the attractive force of the magnet 17.

$$mx+(1/2)kx^2=PF_{in} \quad (1)$$

Here m is the equivalent mass, x is the main valve lifting amount, k is the spring constant of the valve spring 16, P is the pressure in the pressure chamber 18, and $F_{in}$ is the flow of fuel introduced into the pressure chamber 18.

The equivalent mass m and spring constant k are known constants. Hence when the pressure P can be regarded as constant, the lift amount x is a function of the fuel flow $F_{in}$ alone. In this aspect, by controlling the turn-on time of the electromagnetic solenoid 28, the valve-open time of the balance valve 21 can be changed continuously, and together with this the fuel flow $F_{in}$ can be controlled. Hence it is possible to freely control not only the main valve open/close timing, but the main valve lift amount x as well.

Next, when the main valve is in motion, the following continuous eq. (2) obtains for the pressure chamber 18.

$$F_{in}=Ap\cdot dx/dt+Vcc/K\cdot dPcc/dt \quad (2)$$

Here $F_{in}$ is the fuel flow introduced into the pressure chamber 18, Ap is the cross-sectional area of the piston 13, x is the main valve lift amount, Vcc is the capacity of the pressure chamber 18, K is the bulk modulus, and Pcc is the fuel pressure.

From this equation, it is seen that while the main valve is falling, a drop in the pressure in the pressure chamber 18 occurs which is proportional to the main valve velocity dx/dt. When as a result of this drop in pressure, the pressure in the pressure chamber 18 falls below the pressure of the low-pressure chamber 32, the second actuating valve 34 opens. As a result, low-pressure fuel is introduced into the pressure chamber 18 in an amount equivalent to the first term on the right in above eq. (2), (piston cross-sectional area Ap)×(main valve lift amount x). As a result the main valve motion is not impeded. In general, the energy is the pressure times flow, as indicated by the right-hand side of eq. (1). The flow amount is determined uniquely when the piston cross-sectional area Ap and main valve velocity dx/dt are determined. Hence in order to reduce the energy loss, it is effective to utilize low pressure. This is the reason why in this aspect the low-pressure fuel is introduced into the pressure chamber 18 during main valve lifting. By this means, unnecessary energy consumption can be reduced.

Next, when there is no inflow or outflow of fuel (pressure) in the pressure chamber 18, the stationary state of the main valve is maintained. As a result, the main valve can be held in an open state for a desired length of time, and can also be held in a partly open state.

However, when the engine is supercharged, if the main valve is an intake valve, a force acts on the main valve in the open-valve direction (downward) during main valve lifting. In order to avoid valve-opening action due to this force, normally the set force of the main valve spring 16 must be made comparatively high. In this aspect, Fs is approximately 30 kgf. However, as a consequence the force in the closed-valve direction (upward) and the load are increased still more as the main valve lifted, so that greater driving energy is required for main valve lifting.

Figure 3:
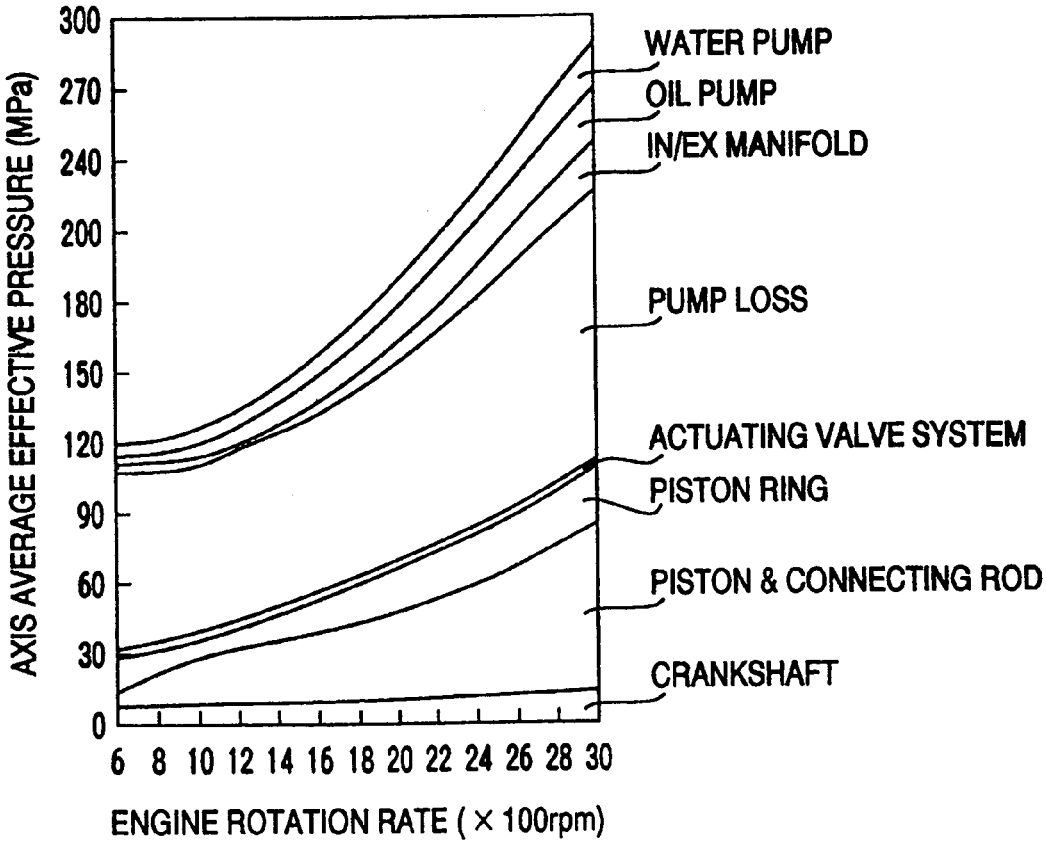
FIG. 3 is a graph showing friction losses in an ordinary cam-driven diesel engine.

In an ordinary cam-driven valve mechanism, a spring force presses on the cam face on the closed valve side, so that there is action to recover energy and the energy for valve driving is minimal. FIG. 3 shows friction losses for each component in a diesel engine using such a valve mechanism; the vertical axis shows the axis average effective pressure. This is the negative work associated with friction loss, divided by the engine revolution rate; that is, each fractional loss, as measured by the analytical friction method, is shown as a function of the engine revolution rate. From the results, the fraction of the total friction accounted for by the valve system is from 2 to 4%, and by multiplying this figure by the input energy, the energy required for driving of the valve system can be computed. As a result of calculations, the driving energy required per valve is found to be 1.65 J.

However, in a camless method such as that of this aspect, energy recovery is difficult. Hence ordinarily the valve driving energy of a camless method would be higher than that of a cam driving method, with possible adverse results for output and fuel efficiency.

Hence in this aspect, in addition to the valve spring 16, a magnet 17 is also used.

In general, the force Fm between magnets is expressed by eq. (3).

$$Fm=1/(4\pi\mu_0)\cdot qmqm'/r^2 \quad (3)$$

Here $\mu_0$ is the magnetic permeability, qm and qm' are magnetic charges, and r is the distance.

Hence in this case of this aspect, as the main valve is lifted, the force decreases in inverse proportion to the square of the distance between the magnet 17 and the flange portion 15. As a result, even when high lift is obtained, the energy for main valve driving is small, so that output and fuel efficiency are improved.

As seen from eq. (1), the driving energy is in theory determined by the product of the equivalent mass m and the main valve lifting amount x. The main valve lifting amount x is uniquely determined according to the engine performance, so that in order to reduce the driving energy, the equivalent mass m must be reduced. Here, the equivalent mass means the mass of the main valve itself, plus the load from the valve spring and similar. In actuality, because it is not possible to greatly reduce the mass of the main valve itself, in this aspect attention was focused on load components.

That is, the main valve must be supported by a high force of approximately Fs=30 kgf during valve-closing seating, in order that valve opening does not occur in response to supercharging pressure. If this force is provided only by the set load of an ordinary coil spring, of course the force (load) to hold the main valve in the open position will increase as the main valve is lifted. This is shown in FIG. 4; as indicated by the dot-dash line, as the main valve lifting (horizontal axis) increases, the force to hold the main valve open (vertical axis) increases.

On the other hand, a magnet has characteristics such that the force is attenuated in inverse proportion to the square of the distance, as shown by the solid line in the figure. Consequently in the case of this aspect, in which a magnet is used together with a valve spring, the valve-open holding force characteristic can be designed to be as shown by the dot-dot-dash line in the figure. Hence compared with a case in which only a valve spring is used, the valve-open holding force can be reduced, and consequently the driving energy is decreased.

Stated more simply, a valve spring (with an initial load of less than 30 kgf in the valve-closed state) which is weaker than the valve spring normally required (with an initial load in the closed state of 30 kgf or higher) is used, and the deficiency in the spring load is augmented by a magnet, so that when the main valve is closed the required load of Fs=30 kgf is always obtained. When the main valve is opened, on combining the spring the load of which tends to decrease as the lift amount increases, the minimum required load to close the main valve is secured, so that even as the lift amount increases the consumption of excessive driving energy can be avoided.

Figure 4:
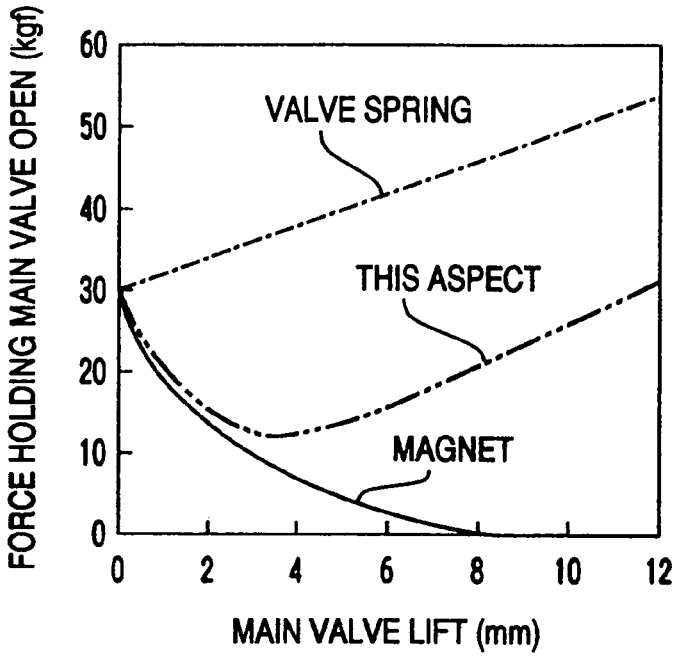
FIG. 4 is a graph comparing the open-valve holding force of a valve and magnet.
Figure 5:
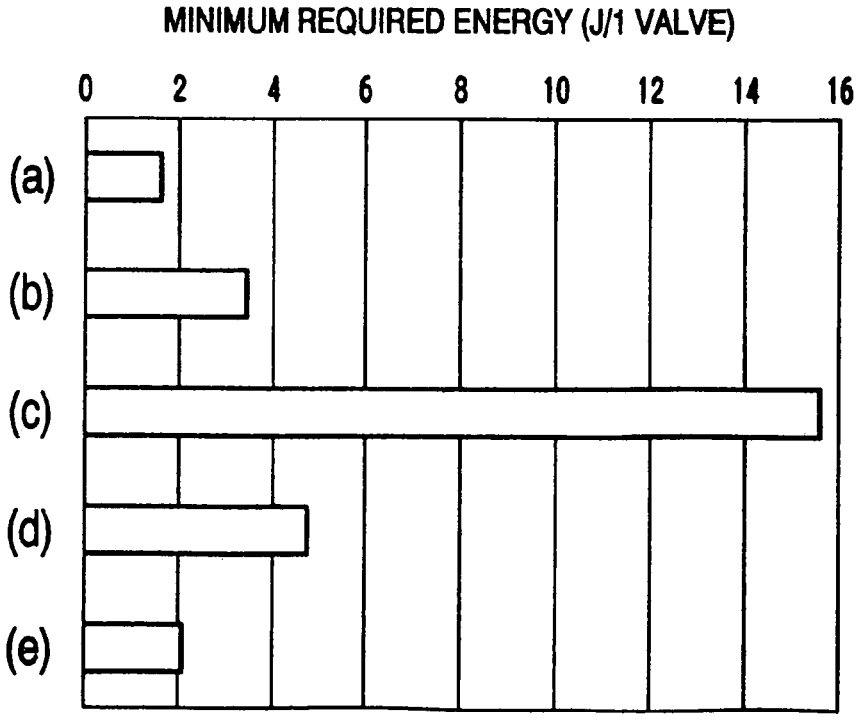
FIG. 5 is a graph comparing the energy necessary for maximum valve lifting.

FIG. 5 shows the results of calculations of the driving energy, based on the characteristics of the valve spring and magnet shown in FIG. 4. (with different absolute values). FIG. 5 shows the minimum energy required to lift one valve by a maximum lift amount $L_{max}$=11.8 mm (See FIG. 2).

As explained above, when using ordinary cam driving the driving energy is 1.65 J, as shown in FIG. 8*a*. In contrast, in the case of a camless design in which the magnet 17 and low-pressure chamber 32 in this aspect are omitted and the force Fs=30 kgf for closed-valve seating is secured using only a valve spring, the higher energy of 4.85 J is required, as shown in FIG. 8*d*. For reference, when the force Fs=30 kgf for closed valve seating is secured using a hydraulic pressure of 4.43 MPa in place of a valve spring and magnet, in a camless method in which the driving energy is reduced by low-pressure introduction from the low-pressure chamber, the energy is 3.48 J, as in FIG. 8*b*. If the hydraulic pressure is raised to 20 MPa, an extremely high energy of 15,67 J is necessary, as shown in FIG. 8*c*. On the other hand, when a magnet is used and low pressure is introduced as in this aspect, the energy is greatly reduced as in this aspect, the energy is greatly reduced to 2.1 J as in FIG. 8*e*, comparable to an ordinary cam-driven design. The above results substantiate the superiority of this aspect.

When a magnet is not used, the closed-valve holding force Fs=30 kgf must be generated by another method. If a spring or hydraulic pressure is used, driving losses increase as explained above, and so these methods cannot be called effective. However, if these are used the device itself is functional.

In this aspect, in addition to a permanent magnet, an electromagnet or similar can also be used. However, a permanent magnet is preferable insofar as lower costs are incurred and the driving energy of electromagnet is not required.

Figure 6:
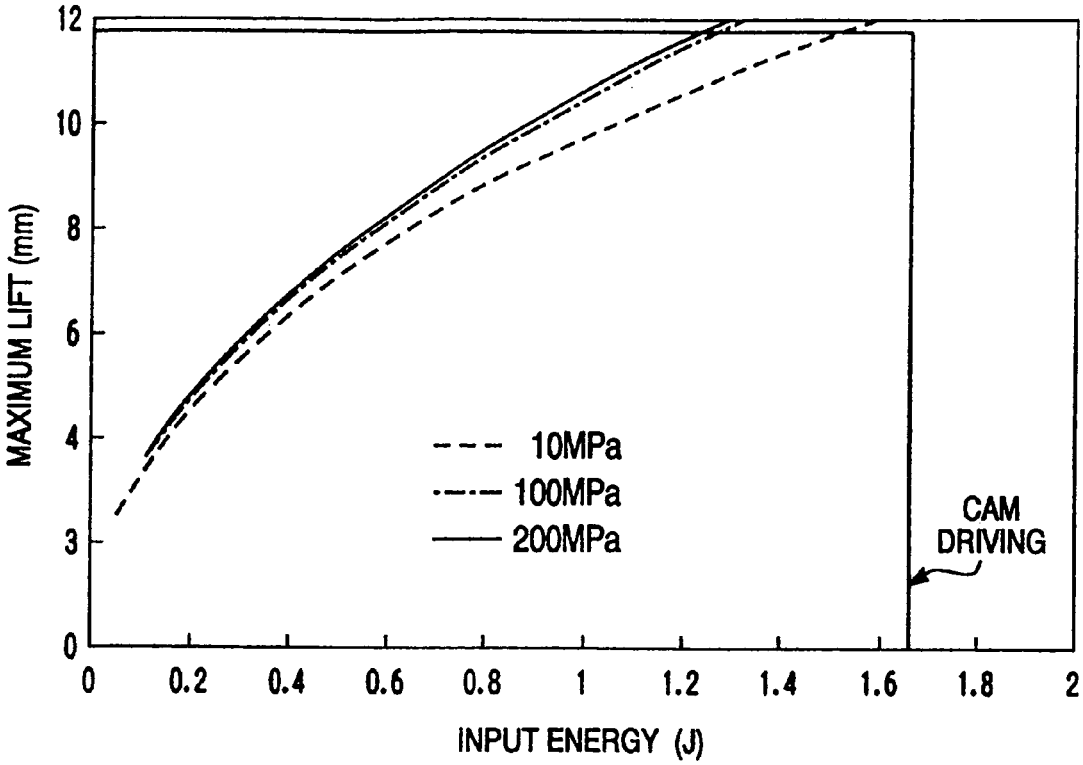
FIG. 6 is a graph comparing the valve driving efficiency at different high-pressure values.

In this aspect, it is clear that as the pressure introduced into the pressure chamber 18 is increased, the efficiency is also increased. FIG. 6 shows the relation between the input energy (along the horizontal axis) and the main valve maximum lift (vertical axis), investigated with the pressure of the high-pressure fuel introduced into the pressure chamber 18 set to 10 MPa (dash-line), 100 MPa (dot-dash line), and 200 MPa (solid line). It is seen that the higher the pressure, the better is the efficiency. In ordinary cam driving, a maximum lift of $L_{max}$=11.8 mm is obtained at an energy of 1.65 J; a characteristic comparable to this is obtained even at 10 MPa. However, if the pressure is raised further, the energy necessary for the same lifting is reduced, and the energy efficiency can be improved. This aspect, which uses a common rail pressure as high as several hundred MPa, is in this sense extremely effective for reducing the driving energy. Because separate equipment to generate high pressure is not needed, the device can be simplified, thereby contributing to cost reduction.

Figure 7:
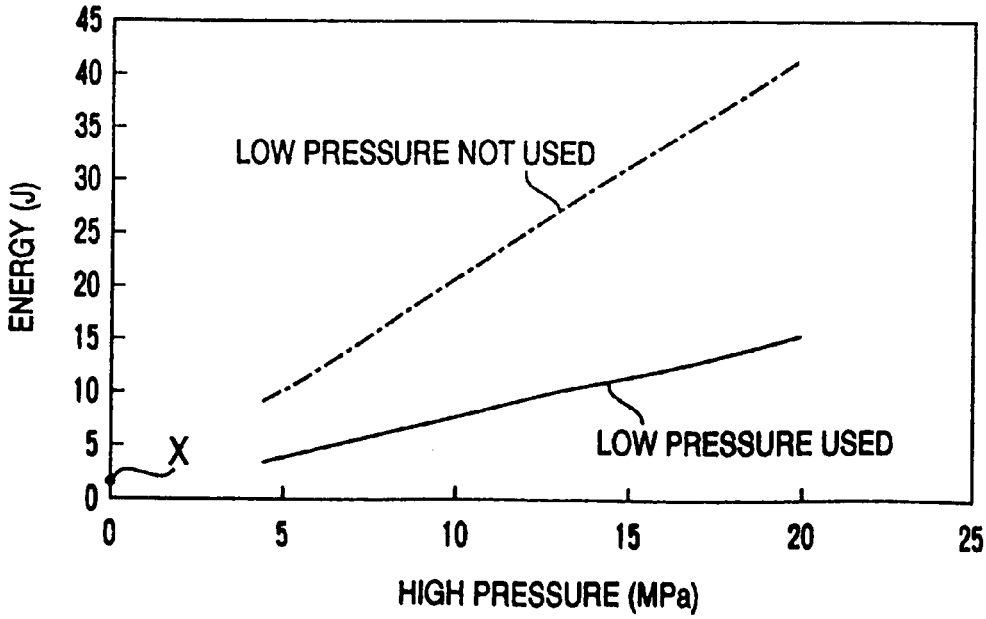
FIG. 7 is a graph showing the results of studies of the effectiveness of low pressure use; and, FIG. 8 is a time chart showing the operating state of each portion in the valve driving device of this aspect.

Next, the results of studies of using low-pressure effectiveness in main valve lifting appear in FIG. 7. Here a device similar to that of this aspect is considered, and cases in which low pressure is introduced into the pressure chamber (low pressure used, solid line) and in which low pressure is not introduced (low pressure not used, dot-dash line) were studied. The energy (vertical axis) required to lift the main valve the maximum $L_{max}$=11.8 mm was studied as a function of the high pressure (horizontal axis) introduced into the pressure chamber. In ordinary cam driving the energy required is 1.65 J, indicated by the x.

As clear from the figure, when low pressure is used the energy needed is from ½ to ¼ that required when low pressure is not used. Thus the superiority of low-pressure use is substantiated.

Further, this aspect has the following structural characteristic.

As shown in FIG. 1, in this aspect the piston 13 is not removed from the piston insertion hole 44, and the ratio of the increase in capacity of the pressure chamber 18 to the amount of movement of the piston 13 is held constant, during the interval from the time the main valve 11 is fully closed until it is fully opened. Hence all the energy associated with the pressure of the high-pressure fuel or low-pressure fuel introduced into the pressure chamber 18 can be converted efficiently into kinetic energy of the main valve 11, so that energy losses can be reduced and driving losses can also be decreased.

Conversely, if a construction were employed in which, during the change in the main valve 11 from fully closed to fully open, the piston 13 were to be removed completely from the piston insertion hole 44 and the cross-sectional area of the pressure chamber 18 were suddenly expanded, so that the ratio of the increase in volume of the pressure chamber 18 to the movement of the piston 13 increased at the instant in which the piston 13 were removed, then the pressure of the pressure chamber 18, which had thus far been satisfactorily increased, would be decreased from the instant of removal of the piston 13, and so would not be effectively converted into kinetic energy of the main valve 11. Compared with such a construction, the construction of this aspect enables effective utilization of the energy associated with pressure for motion of the main valve 11 during the interval from the fully-closed to the fully-open position of the main valve 11, and so is advantageous.

In this aspect, low-pressure fuel is directly introduced into the pressure chamber 18 from the low-pressure chamber 32 positioned on the outside of the actuator body 14, via the passage 31 formed by the dedicated hole provided within the actuator body 14. By this means, the channel for low-pressure fuel can be prevented from becoming excessive, low-pressure fuel can be introduced immediately, and controllability and responsiveness are enhanced. In addition, the location of check valve 34 in the exit part of the low-pressure passage 31 which is contiguous to the pressure room 18 allows for the shortest possible time lag since the check valve 34 opens until low-pressure fuel is introduced into the pressure room 18. This is also very effective in controllability and in response improvement. Moreover, the discharge passage 19 is directly connected to the pressure chamber 18, fuel discharge can be immediately conducted, so that this factor also contributes to the controllability and response improvement.

Various other aspects of this invention may be conceived. In the above aspects, the actuating fluid is taken to be engine fuel (light oil), the high pressure actuating fluid is fuel at common-rail pressure, and the low-pressure actuating fluid is fuel at feed pressure; but ordinary oil or similar may be used as the actuating fluid, and the high and low pressure may be created by a separate hydraulic apparatus. In the above aspects, a valve spring and magnet are used in conjunction in order to impel the main valve in the closed-valve direction; however, use of a valve spring alone, or of magnet alone, is conceivable. In the above aspects, a configuration was employed in which the flange portion 15 is attracted by the magnet 17, but such a configuration need not be adopted. The internal combustion engine is not limited to a common rail diesel engine, but may be an ordinary fuel-injection pump type diesel engine, gasoline engine, or similar. The first actuating valve is not limited to the above-described pressure balance type control valve, but may be an ordinary spool type valve or similar. The third actuating valve is not limited to the above-mentioned throttle valves, but may be an ordinary spool valve etc. However, although a spool valve has an advantage such as a large opening area is obtained by short stroke, there is difficulty to take control of minute flux. Hence, when the spool valve is employed, it is preferred to employ piezoelectric elements, giant magnetostriction elements to accelerate the operating speed. In any case, it is preferable that an operating speed of the electrical actuator as the actuating valve is as fast as possible. The above-mentioned pressure balance type control valve is suitable to satisfy the operating high-speed and effective responsiveness. It is also possible to employ piezoelectric elements, giant magnetostriction elements or similar in place of electromagnetic solenoid of the electrical actuator for the first actuating valve which is the pressure balance type control valve of this embodiment.

By means of the above-described invention, the excellent feature is displayed such that driving energy can be decreased and output and fuel efficiency can be enhanced upon the valve driving.

This invention can apply to any internal-combustion engines equipped with an intake valve or an exhaust valve, such as a vehicle, diesel engine or gasoline engines for industrial purpose or multi purpose.

What is claimed is:

1. A valve driving device of an internal combustion engine, to drive the opening and closing of a main valve serving as an intake valve or an exhaust valve of the internal combustion engine, comprising;

a pressure chamber to which pressurized actuating fluid is supplied in order to open the main valve;

high-pressure actuating fluid supply means for supplying the high-pressure actuating fluid to the pressure chamber during the prescribed interval of the main valve initial opening period;

low-pressure actuating fluid introduction means for introducing the low-pressure actuating fluid into the pressure chamber after the prescribed interval of the main valve initial opening period has elapsed;

actuating fluid discharge means for discharging the actuating fluid from the pressure chamber in order to close the main valve;

the high-pressure actuating fluid supply means comprising a first actuating valve to switch between supplying and halting the supply of the high-pressure actuating fluid to the pressure chamber;

the low-pressure actuating fluid introduction means comprising a second actuating valve to switch between introducing and halting the introduction of the low-pressure actuating fluid to the pressure chamber; and the actuating fluid discharge means comprising a third actuating valve to switch between discharging and halting the discharge of the actuating fluid from the pressure chamber; and the first actuating valve comprising a needle-shaped balance valve; a supply passage, facing toward the one end of the balance valve, circulating the high-pressure actuating fluid which is supplied to the pressure chamber, which is opened and closed by the balance valve; a valve control chamber, facing toward the other end of the balance valve, to which the high-pressure actuating fluid for driving the balance valve in the closed direction is introduced; a spring for impelling the balance valve toward the closed direction; an armature for opening and closing an exit of the valve control chamber; and an electrical actuator for driving the opening and closing of the armature in response to the ON/OFF signal.

2. A valve driving device of an internal combustion engine according to claim 1, wherein the high-pressure actuating fluid supply means supplies the high-pressure actuating fluid in the midst of the prescribed interval of the main valve opening.

3. A valve driving device of an internal combustion engine according to claim 1, wherein the low-pressure actuating fluid introduction means comprises a low-pressure chamber in which the low pressure fluid is stored and a low pressure passage connected to the pressure chamber and directly introduces the low-pressure actuating fluid stored in the low-pressure chamber to the pressure chamber; the second actuating valve comprises a check valve provided at an exit part of the low-pressure passage.

4. A valve driving device of an internal combustion engine according to claim 1, wherein the electrical actuator comprises an electromagnetic solenoid.

5. A valve driving device of an internal combustion engine according to claim 1, wherein the third actuating valve opens when the main valve starts closing, and closes before the main valve is fully closed.

6. A valve driving device of an internal combustion engine according to claim 1, wherein one of:

a valve spring;

a magnet; and both a valve spring and a magnet;

is provided to impel the main valve toward the closed direction.

7. A valve driving device of an internal combustion engine according to claim 6, wherein both of the valve spring and the magnet are provided.

8. A valve driving device of an internal combustion engine according to claim 6, wherein the magnet comprises a permanent magnet.

9. A valve driving device of an internal combustion engine according to claim 1, wherein the piston, connected to the main valve, having a pressure-receiving face which is partitioning one side of the pressure chamber is provided, and during the period when the main valve changes from fully closed to fully open, the ratio of the increase amount of the volume of the pressure chamber to the amount of the piston movement is held constant.

10. A valve driving device of an internal combustion engine according to claim 1, wherein the internal combustion mechanism comprises a common-rail diesel engine; the actuating fluid comprises engine fuel; the high-pressure actuating fluid comprises fuel which is pressured and stored in the common-rail; and the low-pressure actuating fluid comprises fuel at feed pressure.

* * * * *